US006726541B2

(12) United States Patent
Nakamura et al.

(10) Patent No.: US 6,726,541 B2
(45) Date of Patent: Apr. 27, 2004

(54) CLEANING SHEET

(75) Inventors: Eiji Nakamura, Tokyo (JP); Masaaki Tamura, Shiga (JP); Kohzoh Habuchi, Shiga (JP)

(73) Assignees: Nihon Microcoating Co., Ltd., Tokyo (JP); International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/163,150

(22) Filed: Jun. 3, 2002

(65) Prior Publication Data

US 2003/0068967 A1 Apr. 10, 2003

(30) Foreign Application Priority Data

Oct. 9, 2001 (JP) ..... 2001-310990

(51) Int. Cl.[7] ..... B24B 1/00

(52) U.S. Cl. ..... 451/41; 451/523; 451/526; 451/528

(58) Field of Search ..... 451/41, 523, 526, 451/528, 532, 527, 538; 15/208, 210.1, 211; 51/294, 295, 299

(56) References Cited

U.S. PATENT DOCUMENTS

| | | | | | |
|---|---|---|---|---|---|
| 3,653,859 | A | * | 4/1972 | Zimmer et al. | 451/533 |
| 4,111,666 | A | * | 9/1978 | Kalbow | 51/295 |
| 4,287,685 | A | * | 9/1981 | Marton | 451/359 |
| 5,429,545 | A | * | 7/1995 | Meyer | 451/523 |
| 5,692,949 | A | * | 12/1997 | Sheffield et al. | 451/538 |
| 5,938,515 | A | * | 8/1999 | McLain et al. | 451/528 |
| 6,089,965 | A | * | 7/2000 | Otawa et al. | 451/527 |

* cited by examiner

*Primary Examiner*—Lee D Wilson
(74) *Attorney, Agent, or Firm*—Beyer Weaver & Thomas LLP

(57) ABSTRACT

A cleaning sheet has a foamed sheet and a polishing layer with abrading particles on its surface. Mutually disconnected indentations are formed through the polishing layer reaching the foamed sheet in a uniform point pattern including a plurality of mutually adjacent ginkgo-leaf shaped figures for collecting cullet and dust particles therethrough into air bubbles opening on the upper surface of the foamed sheet.

8 Claims, 3 Drawing Sheets

CLEANING SHEET

BACKGROUND OF THE INVENTION

This invention relates to a cleaning sheet intended for removing dust and other contaminating particles attached on the surface of a solid object such as a glass, plastic or metallic object.

With such particles attached on the surface of a product, not only is its external appearance adversely affected but also its functional characteristic may be affected. In view of such possibilities, it is a common practice to remove attached particles from the surface of not only a product as a whole but also each of its constituent members during its production or fabrication.

If there are dust particles and oily contaminating particles on the surface of a product such as a lens or a liquid crystal panel, its optical characteristics such as its index of refraction and optical transmissivity are degraded. Thus, contaminant particles are removed from such products. In the case of a product such as a ventilator fan or a filter, on the other hand, not only dust particles but also an oily contaminant material such as edible oil or mechanical oil is likely to become attached. In such a case, a mixture of dust particles and an oily substance is likely to drop from the product to pollute the work environment or clog a filter to adversely affect its performance characteristic. In the case of a product used outdoors such as an automobile, dust particles and oily substances can adversely affect the external appearance of the product.

Even during the production or fabrication process of these products, cullet and dust particles may become attached to surfaces of their constituent parts to cause damage or adversely affect the external appearance. In the case of a liquid crystal panel, cullet which is generated during its production process must be removed because it tends to damage the product surface. Even oily substances including resin materials and finger marks must be removed because they tend to adversely affect the performance characteristics such as the index of refraction and transmissivity. If paints are applied on the outer panels of an automobile with free flying particles attached thereon, they tend to become separated from the automobile body after the paint is dried such that the original panel surface comes to appear. Thus, removal of attached particles is an important process prior to the application of paints.

Conventionally, contaminant particles such as cullet and dust particles attached to the surface of a product or its parts during the production or fabrication process were removed by contacting the blade of a cutter knife tilted at a specified angle onto the surface to be cleaned and causing the knife to move along the target surface. The cleaning is also effected by using a mop or a brush comprising chemical fibers impregnated with a chemical agent. Use may also be made of a sponge or a piece of cloth, together with water or a cleanser. For removing oily stains such as resin and finger marks, solutions of acetone and alcohol may be used and the target surface is wiped manually.

By a method of using a cutter knife, however, the whole of the cutter knife must be uniformly contacted to the target surface of a solid object but the cutter knife does not remain in the same condition after a repeated use. It wears out, and it wears out unevenly. Thus, it is impossible to make the same contact all the time. In the presence of hard particles such as glass cullet, furthermore, they may be dragged by the cutter blade and end up by damaging the target surface.

Moreover, a cutter knife can itself easily damage a soft surface, say, in the case of an external panel of an automobile or a plastic material. It also goes without saying that a cutter knife cannot remove oily objects such as resin and finger marks.

Removal of oily substances such as resins and finger marks is effected manually by using a solution of acetone and alcohol, but this must be effected as a separate process after dust particles are removed. This means that the cleaning process must be carried out in two stages, and this affects the work efficiency adversely. Because a manual work is involved, the quality control for maintaining a specified level of work quality is difficult. Even with a mop or a brush comprising chemical fibers as described above, removal of a mixture of dust particles and oily substances is difficult because the particles to be removed may pass between the fibers. Moreover, dust particles in narrow corners cannot be removed easily by such a mop or a brush. If the fibers themselves are rubbed against one another, furthermore, the particles once picked up by the fibers may be dropped back onto the target surface from which they were earlier picked up.

In the case of a ventilating fan or an automobile panel, water and a cleanser are commonly used but the use of water means that it can be effected only at a selected place, besides being cumbersome. In addition, the product must be dried after being washed with water, and this makes the process time-consuming.

SUMMARY OF THE INVENTION

It is therefore an object of this invention to provide a cleaning sheet capable of removing dust particles and stains from a target surface of a solid without damaging it.

A cleaning sheet embodying this invention, with which the above and other objects can be accomplished, may be characterized not only as comprising a foamed sheet and a polishing layer with abrading particles on its surface but also wherein a plurality of mutually disconnected indentations are formed through the polishing layer reaching the foamed sheet in a uniform point pattern including a plurality of mutually adjacent ginkgo-leaf shaped figures. Cullet and dust particles can thus be collected, as the cleaning sheet is pressed and rubbed against a target surface to be cleaned, through these indentations and into internal bubbles of the foamed sheet with openings on the upper surface. The arrangement of the indentations in a ginkgo-leaf pattern improves the efficiency of collecting cullet and dust particles.

DETAILED DESCRIPTION OF THE INVENTION

Figure 1:
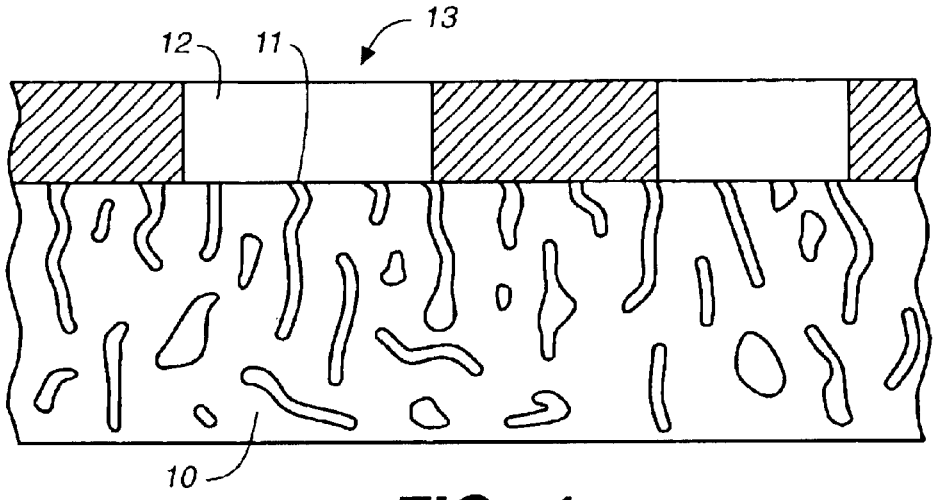
FIG. 1 is a sectional view of a portion of a cleaning sheet embodying this invention.
Figure 2:
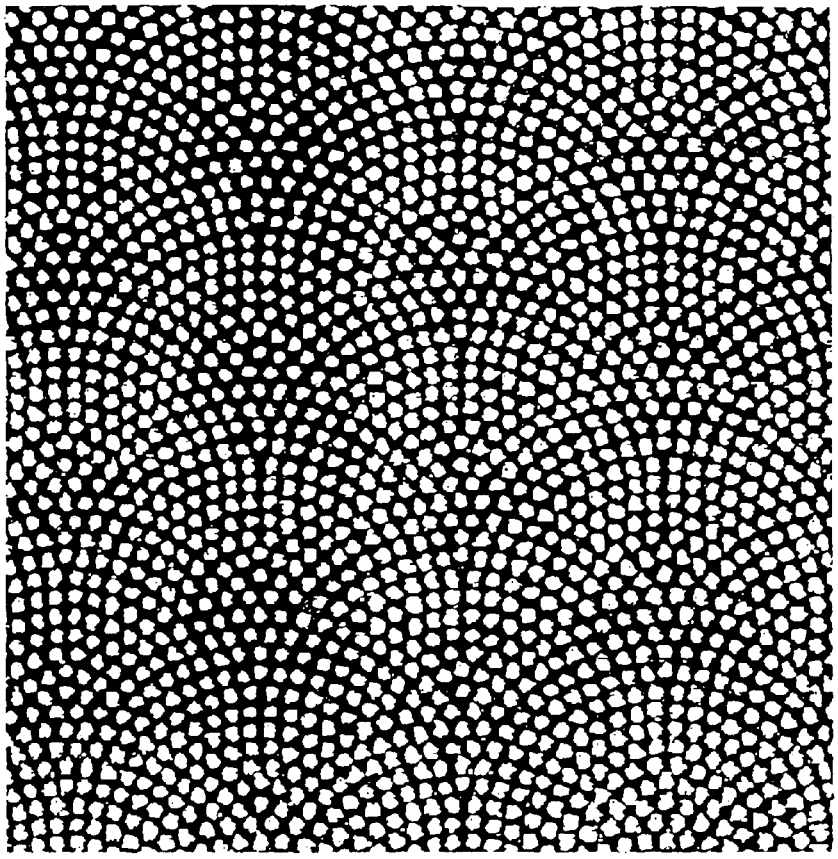
FIG. 2 is a plan view of a portion of a cleaning sheet embodying this invention.

As shown in FIG. 1, a cleaning sheet embodying this invention comprises a foamed sheet 10 and a polishing layer 12 formed on the top surface of the foamed sheet 10. The polishing layer 12 is characterized not only as having a plurality of mutually disconnected indentations (or throughholes) 13 formed therethrough so as to reach the foamed sheet 10 but also wherein these indentations are formed, when seen perpendicularly to the surface of the sheet as shown in FIG. 2, in a uniform point pattern including a plurality of mutually adjacent ginkgo-leaf shaped figures in a same direction.

Figure 3A:
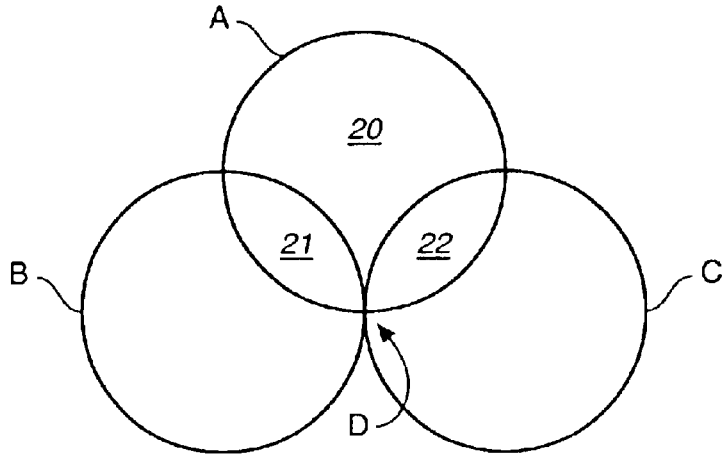
FIGS. 3(*a*) and 3(*b*) are drawings for showing the pattern in which the indentations are arranged as shown in FIG. 2.
Figure 3B:
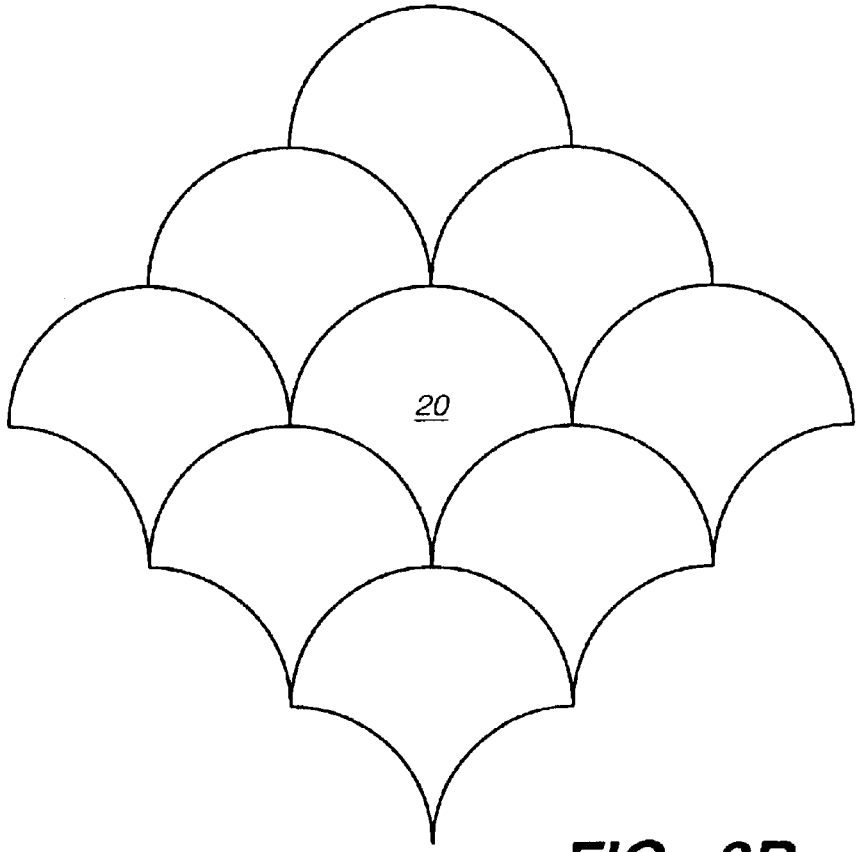

The aforementioned ginkgo-leaf shaped figure is explained more in detail with reference to FIGS. 3*a* and 3*b*. FIG. 3*a* shows two circles B and C of the same radius contacting at one point D and a third circle A of the same radius passing through the contacting point D and having its center on the line tangent to the circles B and C at their contact point D. If the area common to circles A and B is indicated by numeral 21 and that common to circles A and D is indicated by numeral 22, what remains of the interior of circle A after the portions 21 and 22 are removed is herein referred to as the ginkgo-leaf shape (the shape of the region indicated by numeral 20 in FIG. 3*a*. In short, the ginkgo-leaf shape is a shape with a line symmetry surrounded by one inwardly concave semicircle and two inwardly convex quarter circles of the same radius. As shown in FIG. 3*b*, a plurality of these ginkgo-leaf shaped figures are arranged one next to another to make a two-dimensionally extended uniformly continuous pattern, and, as shown in FIG. 2, the indentations 12 are formed through the polishing layer 12 not only on these contour lines shown in FIG. 3*b* but also in the interior of each of the ginkgo-leaf shaped figures, concentrically to the semicircular portion of the figure. The size (roughly the diameter) of each indentation is preferably about 1/20 of the radius of the circles which define the ginkgo-leaf shape explained above.

The foamed sheet 10 may comprise foamed polyurethane, having air bubbles 11 formed inside, as shown in FIG. 1. Some of these air bubbles 11 are internally formed, while some are formed on the top surface and may be externally exposed through one of the throughholes 13 through the polishing layer 12. The hardness of the foamed sheet 10 is a physical quantity to be determined, depending upon the size, and the quantity of the bubbles 11, as well as the thickness of the sheet, according to the purpose of the use of the foamed sheet 10. In general, the hardness (Asker) is in the range of 10–90 degrees, the thickness is 0.1–1 mm and the areal density is 1–60 g/cm$^2$.

Although FIG. 1 does not show any of the bubbles 11 reaching and opening on both surfaces of the sheet 10, this is not intended to limit the scope of the invention. In other words, the foamed sheet 10 may be either non-peameable or permeable to a liquid.

The polishing layer 12 may be formed by applying on the top surface of the foamed sheet 10 an abrading paint material which is a mixture of an adhesive binder and abrading particles and then drying it. Such an abrading paint material may be applied by means of a gravure roll having protrusions on its surface in the aforementioned pattern of ginkgo-leaf shapes. The thickness of the polishing layer 12 is typically in the range of 5–100 $\mu$m.

Examples of the abrading particles include oil-absorbing silicon carbide as well as alumina, carborundum, aluminum oxide, silicon carbide, zirconium oxide, chromium oxide and diamond particles. Their average diameter may be 0.3–40 $\mu$m, or preferably 1.0–30 $\mu$m, and should be selected according to the purpose of the use. If it is for cleaning the glass surface of a liquid crystal panel, for example, abrading particles with average diameter in excess of 40 $\mu$m may tend to scratch the glass surface. If the average diameter of the abrading particles is less than 0.3 $\mu$m, on the other hand, oily contaminants may not be removed efficiently.

Examples of the adhesive binder to be used include a water-soluble polyurethane resin adhesive agent. Preferable examples of diluent for dissolving the adhesive binder include pure water. A solution of alcohol or ketone may be added to pure water in an amount of 3–10%. The viscosity of the mixture of abrading particles and an adhesive binder (or the aforementioned abrading paint material) may preferably be about 80–150 cp.

A plastic sheet such as comprising polyethylene terephthalate may be used as a backing to the foamed sheet.

When a cleaning sheet of this invention is used for removing contaminants such as cullet and dust particles from the surface of a panel substrate such as of a liquid crystal panel, water or a cleanser liquid is supplied to the target surface of the panel substrate and thereafter a cleaning pad of this invention is pressed and rubbed against the target surface to be cleaned.

With the cleaning sheet thus structured, particles removed from the target surface by the polishing layer can be taken into the air bubbles on the top surface of the foamed sheet through the throughholes formed through the polishing layer in a ginkgo-leaf shaped pattern. Since the abrading layer is formed over a soft sheet of a foamed material, the cleaning tape can operate flexibly as it is pressed against a hard target surface of a glass material so as to be able to clean it without scratching.

Figure 4:
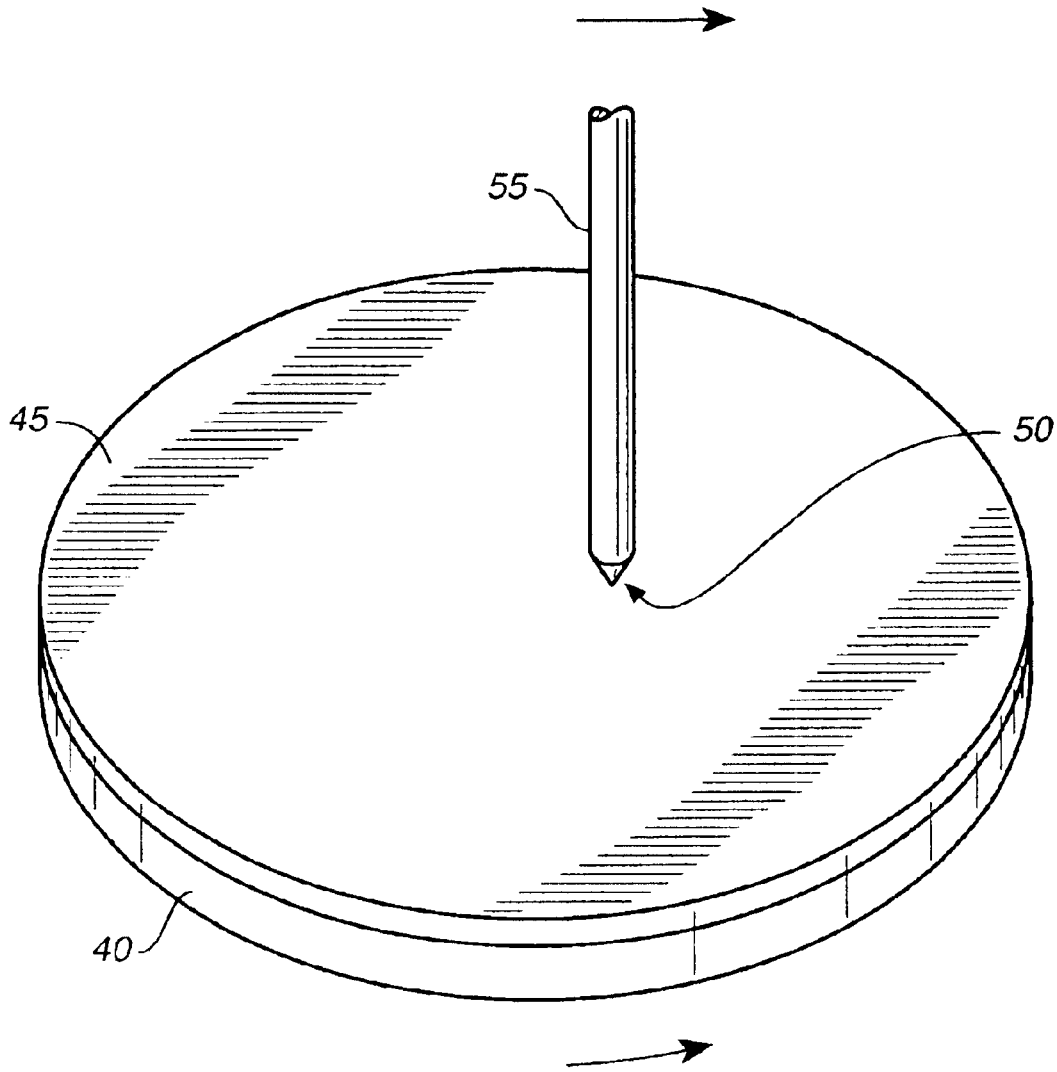
FIG. 4 is a schematic view of a polishing machine which was used for studying the advantage of using a cleaning tape of this invention for polishing.

The invention is described finally by way of experiments performed to compare the results of polishing by using cleaning sheets embodying this invention and a prior art uniformly flat cleaning sheet without any design. The experiments were carried out by using a polishing machine as schematically shown in FIG. 4, by rotating a lapping plate 40 as indicated by an arrow with a cleaning sheet 45 of this invention attached to its surface. A small stainless steel sphere 50 such as the ball at the tip of a ball-point pen was rotatably supported at the tip of an elongated supporting apparatus 55 so as not to roll away and was pressed against the cleaning sheet 45 with a force of 500 g while the supporting apparatus 55 was moved radially outward with respect to the rotating plate 40 without using any polishing liquid (that is, by a so-called dry method).

For test experiments, polishing paint was prepared by mixing abrading particles into a solution obtained by dissolving a water-soluble polyurethane adhesive in an aqueous alcohol or ketone solution. Next, a gravure roll with protrusions in a ginkgo-leaf shaped patterns on the surface (diameter of protrusions about 1.0 mm, center-to-center distance between adjacent patterns about 3.0 mm, and diameter of ginkgo-leaf shape pattern about 30 mm) to apply this paint on the surface of a sheet of foamed polyurethane. Next, it was dried to obtain cleaning sheets with a polishing layer of thickness 10 $\mu$m in a ginkgo-leaf shaped pattern. Abrading particles were alumina (WA600) with average diameter of 30 $\mu$m for Test Example 1, alumina (WA800) with average diameter of 20 $\mu$m for Test Example 2, alumina (WA1000) with average diameter of 16 $\mu$m for Test Example 3 and alumina (WA2000) with average diameter of 9 $\mu$m for Test Example 4.

Comparison examples were produced by applying the same polishing paint on the surface of a sheet of foamed polyurethane and drying it to form a uniformly flat polishing layer of thickness 10 $\mu$m. The same abrading particles used for Test Examples 1–4 were used respectively for Comparison Examples 1–4. The measured stock removal was 17.7 mg, 15.8 mg, 12.2 mg and 8.3 mg in Test Examples 1–4, respectively, and 8.0 mg, 7.8 mg, 6.4 mg and 4.9 mg in Comparison Examples 1–4, respectively. This indicates that the stock removal according to this invention was about twice as large as by using a prior art cleaning sheet. In other words, it may be concluded that cleaning sheets according to this invention are twice as effective in removing glass cullet and similar particles as prior art cleaning sheets.

What is claimed is:

1. A cleaning sheet comprising:

a foamed sheet having an upper surface; and a polishing layer on said upper surface, said polishing layer having an externally exposed surface and a plurality of mutually disconnected indentations formed through said externally exposed surface and reaching said foamed sheet, said indentations forming a uniform point pattern on said externally exposed surface, said point pattern including a plurality of mutually adjacent ginkgo-leaf shaped figures in a same direction, wherein said ginkgo-leaf shaped figures are each a geometrical figure with a line symmetry surrounded by one inwardly concave semicircle and two inwardly convex quarter circles, said semicircle and said two quarter circles being of a same radius.

2. The cleaning sheet of claim 1 wherein said foamed sheet comprises foamed polyurethane.

3. The cleaning sheet of claim 2 wherein said foamed sheet has hardness of 10–90 degrees, thickness of 0.1–1 mm and areal density of 1–60 g/cm$^2$.

4. The cleaning sheet of claim 3 wherein said polishing layer has thickness of 5–100 $\mu$m, said abrading particles have an average diameter of 0.3–40 $\mu$m.

5. The cleaning sheet of claim 2 wherein said polishing layer has thickness of 5–100 $\mu$m, said abrading particles have an average diameter of 0.3–40 $\mu$m.

6. The cleaning sheet of claim 1 wherein said foamed sheet has hardness of 10–90 degrees, thickness of 0.1–1 mm and areal density of 1–60 g/cm$^2$.

7. The cleaning sheet of claim 6 wherein said polishing layer has thickness of 5–100 $\mu$m, said abrading particles have an average diameter of 0.3–40 $\mu$m.

8. The cleaning sheet of claim 1 wherein said polishing layer has thickness of 5–100 $\mu$m, said abrading particles have an average diameter of 0.3–40 $\mu$m.

* * * * *